US009163302B2

(12) United States Patent
Iveland et al.

(10) Patent No.: US 9,163,302 B2
(45) Date of Patent: Oct. 20, 2015

(54) CASTABLE HEAT RESISTANT ALUMINIUM ALLOY

(75) Inventors: Terje Iveland, Sunndalsøra (NO); Stig Brusethaug, Sunndalsøra (NO); Petter Åsholt, Sunndalsøra (NO); Bruno Barlas, St Cyr sur Loire (FR); Denis Massinon, Liancourt (FR); Philippe Meyer, Agnetz (FR)

(73) Assignees: NORSK HYDRO ASA, Olso (NO); MONTUPET S.A., Clichy Cedex (FR)

( * ) Notice: Subject to any disclaimer, the term of this patent is extended or adjusted under 35 U.S.C. 154(b) by 0 days.

(21) Appl. No.: 13/703,058

(22) PCT Filed: Jun. 16, 2011

(86) PCT No.: PCT/NO2011/000174

§ 371 (c)(1),
(2), (4) Date: Feb. 26, 2013

(87) PCT Pub. No.: WO2011/159169

PCT Pub. Date: Dec. 22, 2011

(65) Prior Publication Data

US 2013/0149190 A1 Jun. 13, 2013

(30) Foreign Application Priority Data

Jun. 16, 2010 (NO) ..... 20100865

(51) Int. Cl.

| | |
|---|---|
| ***C22C 21/02*** | (2006.01) |
| ***C22C 21/14*** | (2006.01) |
| ***F02F 7/00*** | (2006.01) |

(52) U.S. Cl.

CPC ..... *C22C 21/02* (2013.01); *C22C 21/14* (2013.01); *F02F 7/0085* (2013.01)

(58) Field of Classification Search

USPC ..... 420/535, 537, 544

See application file for complete search history.

(56) References Cited

U.S. PATENT DOCUMENTS

2006/0115375 A1 6/2006 Barth

FOREIGN PATENT DOCUMENTS

| | | | |
|---|---|---|---|
| DE | 102006059899 A1 * | 6/2008 | ..... C22C 21/06 |
| DE | 10 2009 036 056 | 2/2011 | |
| SU | 1223653 | 6/1990 | |

OTHER PUBLICATIONS

International Search Report issued Sep. 13, 2011 in International (PCT) Application No. PCT/NO2011/000174.

Written Opinion of the International Searching Authority issued Sep. 13, 2011 in International (PCT) Application No. PCT/NO2011/000174.

* cited by examiner

*Primary Examiner* — Melvin C Mayes
*Assistant Examiner* — Alexander Polyansky
(74) *Attorney, Agent, or Firm* — Wenderoth, Lind & Ponack, L.L.P.

(57) ABSTRACT

The present invention relates to a castable heat resistant aluminum alloy for high temperature applications such as components in combustion engines, in particular for the manufacturing of highly loaded cylinder heads, the alloy comprises the following composition: .Si: 6.5-10 wt %.Mg: 0.25-0.35 wt %.Cu: 0.3-0.7 wt %.Hf: 0.025-0.55 wt % Optionally with the addition of: .Ti: 0-0.2 wt %.Zr: 0-0.3 wt %, the balance being made of Al and unavoidable impurities including Fe.

8 Claims, 4 Drawing Sheets

CASTABLE HEAT RESISTANT ALUMINIUM ALLOY

The present invention relates to a castable heat resistant aluminium alloy for high temperature applications such as components in combustion engines, in particular for the manufacturing of highly loaded cylinder heads. More specifically, the material described in this application could be used at temperatures up to 300° C., which is anticipated in future engines.

BACKGROUND OF THE INVENTION

Aluminium alloys used for the manufacturing of cylinder heads are generally from the AlSi family with silicon typically ranging from 5 to 10%. In addition to the lowering of the melting point, silicon addition in the aluminium provides the required casting ability, necessary for the manufacturing of parts with ever increasing geometrical complexity. Most widely used casting alloys for cylinder heads belong to 2 main families for which silicon is ranging between 5% and 10% and copper between 0 and 3.5% (depending on the specifications, and using conditions). The first family relates to AlSi7Mg type of alloys (for example A356 in SAE standard) generally T7 heat treated (complete treatment) alloys, well-known for their excellent castability, good damage tolerance and mechanical properties, except at high temperatures. The second family relates to AlSi 5 to 10% Cu3Mg (for example 319 in SAE standard) generally T5 (aging treatment only) alloys, well-known for their economic interest, mechanical resistance at high temperature but poor damage tolerance.

In both cases, the temperature range in which these alloys can be used is limited to 280° C., as their mechanical properties, in particular yield strength, decrease brutally after a few hours (see for example FIG. 1).

From DE 10 2006 059 899 A1 is known a heat resistant aluminium alloy comprising 4.5-7.5 wt % Si, 0.2-0.55 wt % Mg, 0.03-0.50 wt % Zr and/or 0.03-1.5 wt % Hf, maximum 0.20 wt % Ti, <0.3=wt % Fe, <0.5 Mn, 0.1-1.0 wt % Cu, <0.07 wt % Zn, with the rest Al and impurities maximum 0.03 wt %. This reference appears to be concerned with the Cu content to improve the heat resistance of the alloy in combination with relatively large ranges of Zr and/or Hf. The optimum combination is, however not further verified or documented.

US 2006/0115375 relates to a high strength, thermally resistant and ductile cast aluminium alloy comprising 5.5-7.5 wt % Si, 0.20-0.32 wt % Mg, 0.03-0.50 wt % Zr and/or 0.03-1.50 wt % Hf, 0-0.20 wt % Ti, <0.20 wt % Fe, <0.50 wt % Mn, <0.05 wt % Cu and <0.07 wt % Zn. The objective with this known alloy is to retain its strength values at temperatures equal to or above 150° C. and obtain lower thermal expansion through a reduction of phase formation and thus enhanced thermo-mechanical stability at temperatures up to 240° C. The alloy contains very low amount of Cu (close to zero) and relatively high range of Hf (up to 1.50 wt %) which is very expensive.

BRIEF SUMMARY OF THE INVENTION

With the present invention is provided a castable heat resistant aluminium alloy with improved strength and creep properties at elevated temperatures. Further, the alloy is cheaper than formerly known castable alloys containing Hf since optimal small amounts of Hf are used.

The invention is characterized by the features as defined in the attached independent claim 1.

Advantageous embodiments of the invention are further defined in the attached dependent claims 2-4.

BRIEF DESCRIPTION OF THE SEVERAL VIEWS OF THE DRAWINGS

The present invention will be described in further detail in the following with examples and figures, where.

Figure 1:
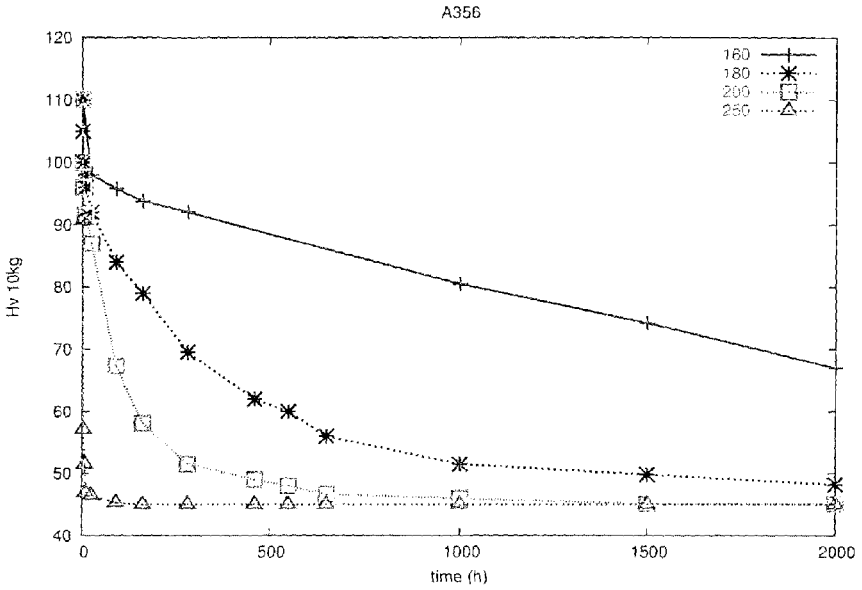
FIG. 1 shows aging estimation by means of hardness measurement as a function of time and temperature for an A356 T7 alloy.

In recent years one of the applicants have developed a casting alloy containing 0.5% of copper (AlSi7Cu05Mg) which is an interesting compromise among alloy families mentioned above and has allowed an improvement of the material stability at temperatures above 200° C., with regards to the reference A356.

Further, one of the applicants has developed an AlSi 10% Cu0.5% Mg alloy for highly loaded diesel heads, as an improvement of AlSi10% Mg secondary alloy.

The invention described hereafter relates to a new material for which the stability range as regards mechanical properties is expanded up to 300° C. and beyond.

The advantage of dispersoid precipitation is already known for many years in tool steels as well as in some aluminium alloys. In particular, alloys such as zirconium containing AlCu5 have been developed for special applications at elevated temperatures. However, these alloys, because of large solidification range, are very difficult to cast and thus unsuitable for the manufacturing of geometrically complex components such as cylinder heads.

Dispersoids are also well known in the aluminium industry as elements used to control the structure of wrought alloys, either to avoid re-crystallization or to control the size of the re-crystallized microstructure.

DETAILED DESCRIPTION OF THE INVENTION

The invention described below relates to the achievement of dispersoid-nanoscale-precipitates, in conventional Aluminium Silicon alloys, for the purpose of increasing the lifetime of components operating at elevated temperatures.

Through personal skills and experiments the inventors arrived at the following inventive alloy composition:

Silicon: 6.5-10 wt %
Magnesium: 0.25-0.35 wt %
Copper: 0.3-0.7 wt %
Hafnium: 0.025-0.55 wt %
and with optional addition of
Titanium: 0-0.2 wt %
Zirconium: 0-0.3 wt %
the balance being made of Al and unavoidable impurities including Fe.

In a preferred embodiment of the invention the copper should be between 0.4 and 0.6 wt %.

Depending on the chemical composition of the alloy, heat treatments should preferably be performed with a heat-up rate of 300° C./h, as follows:

Solutionizing 5 to 10 h (target 5) at 475 to 550° C. (target 525)
Quench (by means of different media: mainly water, but possibly air.
Aging 2 to 8 h (target 5) at 180 to 250° C. (target 200).

Figure 2:
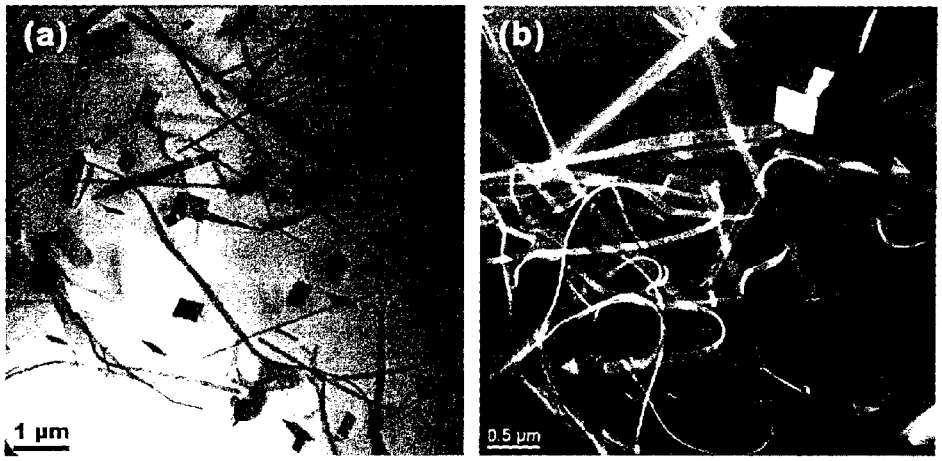
FIG. 2 shows a photo of microstructure of an alloy containing ribbon or belt like precipitates containing Hafnium.

According to the invention, it has been found that the addition of copper and in particular hafnium in a conventional A356 alloy (also called AlSi7Mg), together with a specific heat treatment process, lead to the formation of a unique microstructure, as evidenced by Transmission Electronic Microscope (TEM) observations. Presence of ribbon or belt like hafnium containing precipitates can be seen in the α-aluminium phase as is shown in the attached FIG. 2.

These precipitates are 60 to 240 nm wide and a few to several tens of micrometers long.

Figure 3:
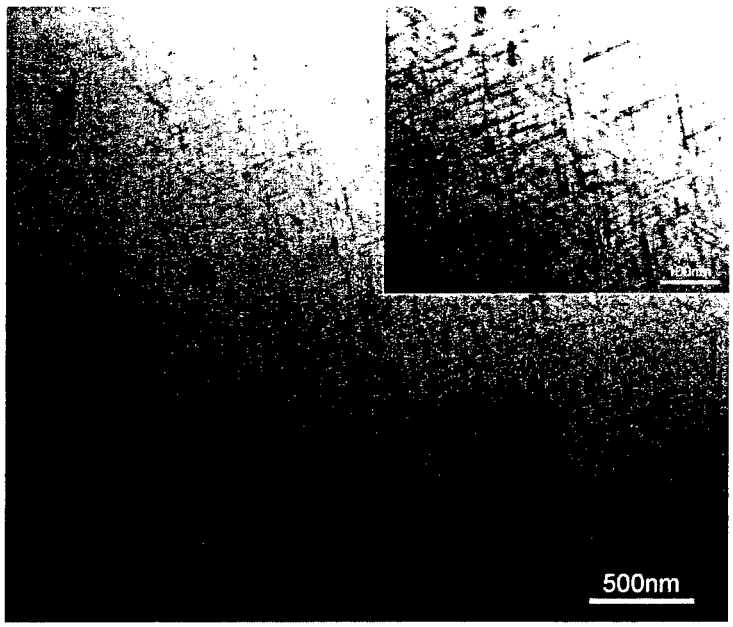
FIG. 3 shows another photo of microstructure of an alloy with the presence of fine hardening MgSi precipitates.

A high density of conventional β" ($Mg_2Si$) precipitates in the α-aluminium phase as can be seen in FIG. 3, ensures that the alloy, after heat treatment, possesses a unique combination of properties, in particular strength at room temperature.

Apparently the addition of copper, in the range of 0.4 to 0.6%, has an effect on the coarsening kinetics of the β" ($Mg_2Si$) precipitates. It is generally acknowledged that, after artificial ageing at temperature above 200° C. (T7 temper), $Mg_2Si$ evolve to coarse β' or β precipitates, leading to loss of coherency and softening of the material. Due to the addition of copper, the coarsening process is apparently retarded with the present invention. Likely copper is also present in the fine distribution of precipitates under the form of Q' phase ($Al_5Cu_2Mg_8Si_7$), as suggested by the thermodynamics simulation at 300° C.

Figure 4:
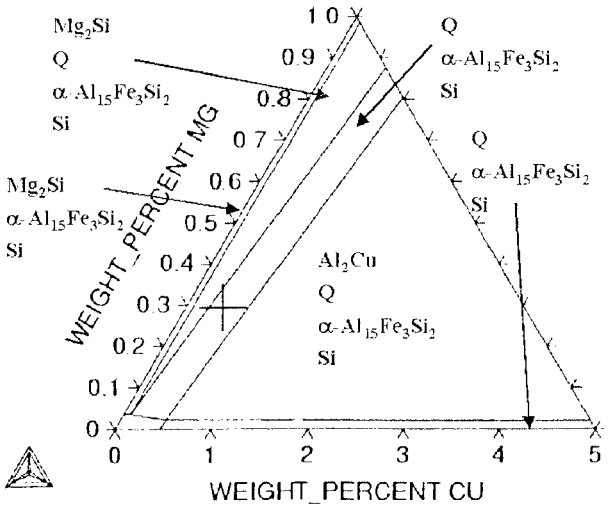
FIG. 4 is a Thermo-Calc™ simulation showing the stability domains of the coexisting equilibrium phases β ($Mg_2Si$), θ ($Al_2Cu$) and Q ($Al_5Cu_2Mg_8Si_7$) at 300° C.

FIG. 4 represents a Thermo-Calc™ simulation showing the stability domains of the coexisting equilibrium phases β ($Mg_2Si$), θ ($Al_2Cu$) and Q ($Al_5Cu_2Mg_8Si_7$) at 300° C. The shown "cross" in FIG. 4 represents the alloy nominal composition point.

Optionally, Zr up to 0.3 wt % and Ti up to 0.2 wt % may be added to the alloy according to the invention. TEM examination of alloys with Zr and Ti additions reveal the presence of rod-shaped AlSiZr and AlSiZrTi precipitates in the microstructure formed during heat treatment.

Experiments.

Tests were performed with alloys as specified in table 1 below to compare the properties of the alloys according to the present invention with different alloys with or without Hf and/or Cu. The alloys where heat treated, i. e. solutionised and aged according to the temperature and time schedule as also specified in the table below.

TABLE 1

| Alloy | Fe wt % | Si wt % | Mg wt % | Cu wt % | Hf wt % | Ti wt % | Zr wt % | Sr wt % | $T_{sol}$ ° C. | $t_{sol}$ hours | $T_{age}$ ° C. | $t_{age}$ hours |
|---|---|---|---|---|---|---|---|---|---|---|---|---|
| A356* | 0.12 | 7.0 | 0.3 | | | 0.13 | | 0.0120 | 540 | 5 | 200 | 5 |
| 319 | 0.45 | 8 | 0.3 | 3 | | .0.12 | | 0.012 | | | 210 | 5 |
| II-2 | 0.12 | 6.86 | 0.32 | | | 0.16 | 0.21 | 0.0090 | 500 | 5 | 200 | 5 |
| II-8** | 0.11 | 7.10 | 0.29 | | 0.53 | | | 0.0098 | 540 | 10 | 200 | 5 |
| II-9** | 0.12 | 8.22 | 0.36 | 0.50 | 0.53 | | | 0.0117 | 525 | 10 | 200 | 5 |
| II-15 | 0.10 | 7.74 | 0.31 | 0.46 | 0,.087 | | 0.14 | 0.0118 | 525 | 10 | 200 | 5 |
| II-16 | 0.12 | 7.87 | 0.38 | 0.49 | 0.327 | | | 0.0151 | 525 | 10 | 200 | 5 |
| II-18 | 0.15 | 7.94 | 0.34 | 0.52 | 0028 | | 014 | 0.0117 | 525 | 10 | 200 | 5 |
| III-3 | 0.13 | 0.04 | | 5.10 | | 0.14 | 0.20 | | 500 | 5 | 230 | 4 |

*Nominal composition
**Hf content only analysed in base alloy (2.12%)

Properties of the Tested Alloys at Elevated Temperature:

Creep experiments were carried out in accordance with ISO standard (EN ISO 204 from August 2009) to demonstrate the impact of the Hf containing precipitate on the material behaviour. Performances were compared with two other AlSi casting alloys, as well as an aluminium copper alloy as specified above.

Figure 5:
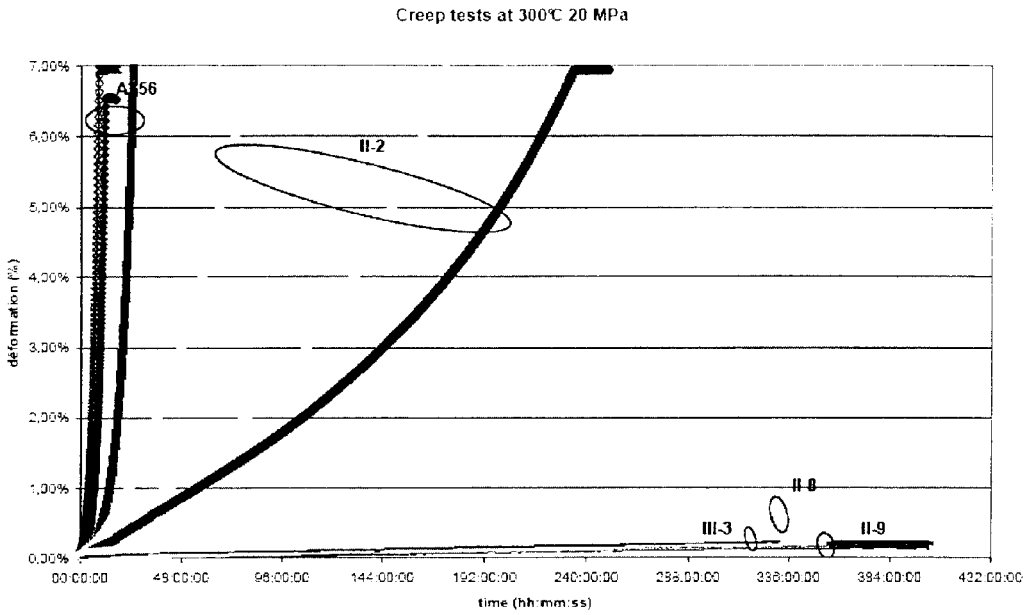
FIG. 5 shows the results of creep tests for the several selected alloys showing total deformation as a function of time, at 300° C. under 20 MPa load.

FIG. 5 shows the deformation as a function of time for a constant load of 20 MPa applied upon the specimen at 300° C.

From FIG. 5 one can see that:

The II-2 alloy containing zirconium in addition to the other usual A356 alloying elements are superior to conventional A356 (AlSi7Mg) alloy.

The III-3 alloy, which is Al 5% Cu with presence of $Al_3Zr$ (Ti) dispersoids, are superior to the II-2 alloy.

The II-8 alloy, which only contains 0.5% Hf in addition to the usual A356 alloying elements, shows properties similar to the III-3 alloy.

The II-9 alloy, which is an alloy according to the invention, show the best creep behaviour. This alloy contains 0.5% copper in addition to 0.5% Hf. It is hypothesized that the addition of hafnium in this material is mainly responsible for this performance, which is also the case for the II-8 alloy. Alloy II-9 also contains slightly more Si, but this is regarded unessential in this regard.

Figure 6:
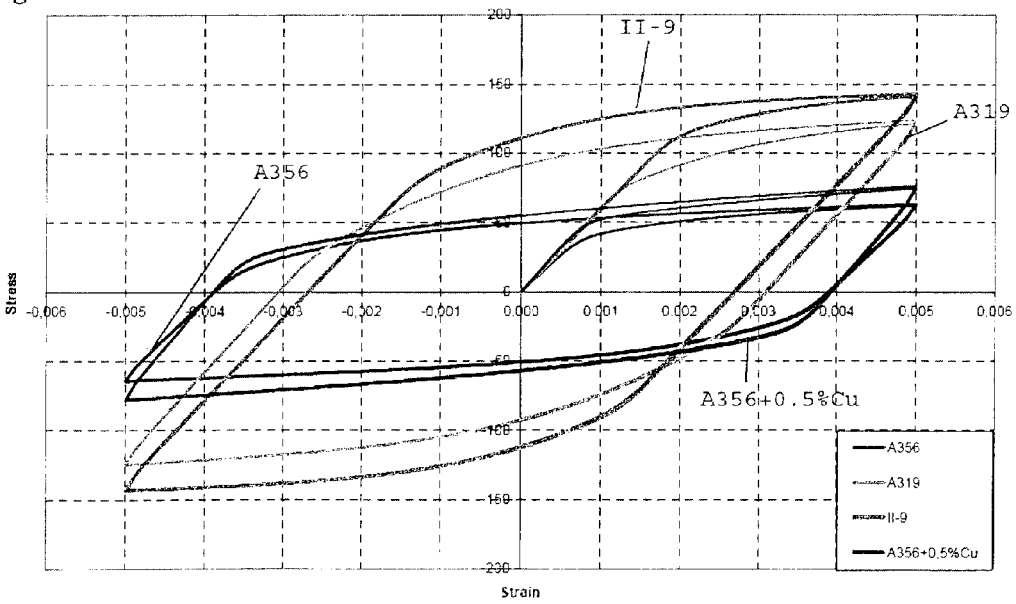
FIG. 6 is a graph showing the low cycle fatigue behaviour for some of the tested alloys at different temperatures (simulated (with a stabilized material) hysteresis loops for different alloys during fatigue tests $$\left(\varepsilon = 0.001s^{1} \text{ and } \frac{\Delta\varepsilon}{2} = 0.005\right)\text{at } 250^\circ \text{ C.}\Big).$$

FIG. 6 is a graph showing low cycle fatigue performance of the II-9 alloy compared with different alloys commonly used in castings listed table 1, namely A356 T7, A356+0.5% Cu T7, and 319 T5.

The low cycle fatigue behaviour was evaluated at different temperatures, and for different imposed plastic deformations. In FIG. 6, the plastic deformation parameter is conventionally designed by $$\frac{\Delta\varepsilon}{2}.$$

The depicted graphs in the figure shows that, at 250° C. the II-9 alloy displays higher yield strength than the A356 and A356+0.5% copper. More surprisingly, it also outperforms the 319 alloy, which contains 3% copper. Quite likely this is the effect of the dispersoid precipitation which brings superior material stability to the II-9 alloy at elevated temperatures.

Figure 7:
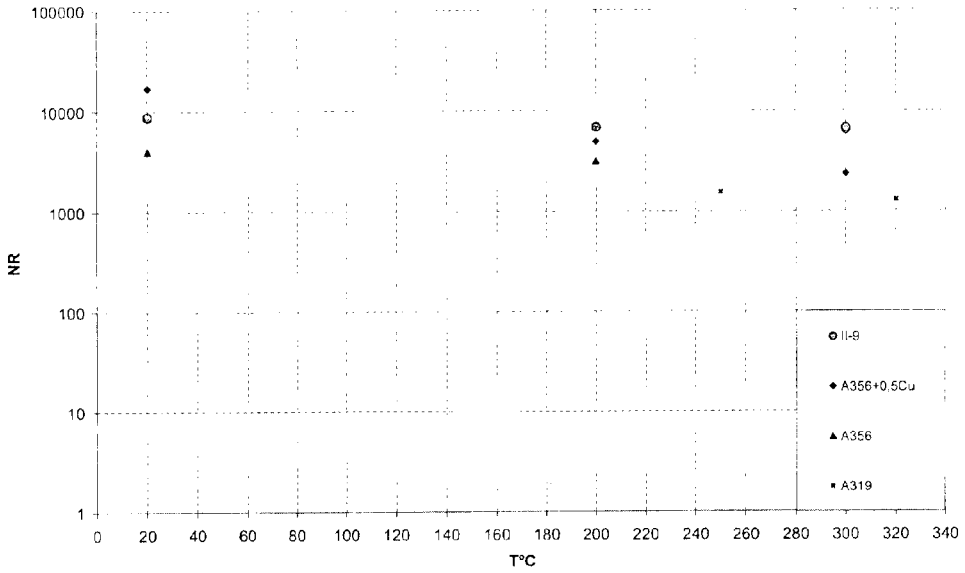
FIG. 7 shows lifetime of some of the tested alloys during Low Cycle fatigue tests $$\left(\varepsilon = 0.001s^{-1} \text{ and } \frac{\Delta\varepsilon}{2} = 0.003\right)$$

Further, FIG. 7 shows the lifetime (number of strain cycles, NR) of the II-9 alloy compared with the same alloys commonly used in castings as mentioned above and listed table 1 during low cycle fatigue tests $$\left(\varepsilon = 0.001s^1 \text{ and } \frac{\Delta\varepsilon}{2} = 0.003\right)$$

In FIG. 7 the life time of the fatigue specimens are plotted as a function of temperature for the different alloys. The more the temperature increases, the more the II-9 alloy outperforms all of the other commonly known alloys.

Figure 8:
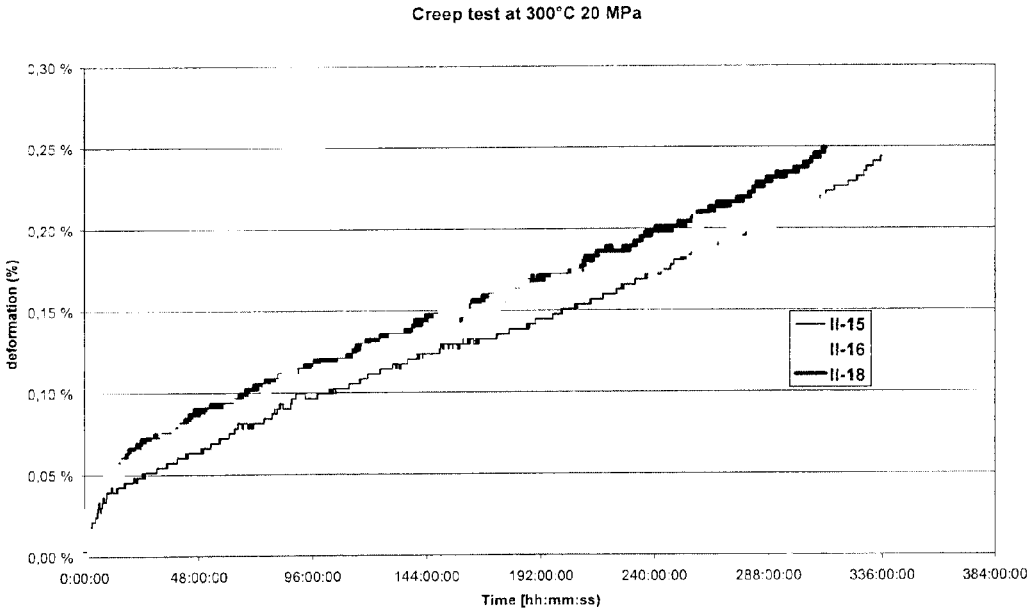
FIG. 8 is a graph showing creep tests with some additional alloys with varying Hf content.

Still further, FIG. 8 is a graph showing creep tests with some additional alloys listed in table 1 (II-15, II-16, og II-18), with varying Hf content. All of the alloys containing Cu, Hf and Zr display rather similar creep behaviour, even the low Hf alloys. Quite likely there is an additive effect of Cu, Hf and Zr on creep properties. Due to the slower coarsening of Hf- and Zr-containing phases the effect of Hf and Zr is assumed to be more persistent than the effect of Cu.

Properties at room temperature:

Properties at room temperature were derived after conventional tensile test. Results are given in the following table 2, in comparison with one of the above-mentioned alloys, A356:

| Alloy | Temper | UTS (MPa) | YS (MPa) | Ap (%) | E (GPa) |
|---|---|---|---|---|---|
| A356 | T7 | 300 | 240 | 7.5 | 70 |
| II-9 | T7 | 326 | 279 | 7.1 | 75 |

As is apparent from table 2, the alloy according to the invention has improved mechanical properties in relation to A356.

The invention claimed is:

1. A castable heat resistant aluminium alloy for high temperature applications such as components in combustion engines, wherein the alloy consists of 6.5-10 wt % Si, 0.25-0.35 wt % Mg, 0.3-0.7 wt % Cu, 0.025-0.55 wt % Hf, 0-0.2 wt % Ti, 0-0.3 wt % Zr, and a balance of Al and unavoidable impurities.

2. The alloy according to claim 1, where the Cu is between 0.4-0.6 wt %.

3. The alloy according to claim 1, where the Hf is between 0.1-0.3 wt %.

4. The alloy according to claim 1, where the Ti is between 0.10-0.20wt % and where the Zr is between 0.10-0.20 wt %.

5. The alloy according to claim 2, where the Hf is between 0.1-0.3 wt %.

6. The alloy according to claim 2, where the Ti is between 0.10-0.20wt % and where the Zr is between 0.10-0.20 wt %.

7. The alloy according to claim 3, where the Ti is between 0.10-0.20wt % and where the Zr is between 0.10-0.20 wt %.

8. The alloy according to claim 5, where the Ti is between 0.10-0.20 wt % and where the Zr is between 0.10-0.20 wt %.

* * * * *